US011285523B2

(12) United States Patent
Zhou et al.

(10) Patent No.: US 11,285,523 B2
(45) Date of Patent: Mar. 29, 2022

(54) METAL FORMING METHOD INCLUDING POST-FORMING STRETCHING TO CONTROL SPRINGBACK

(71) Applicants: Dajun Zhou, Troy, MI (US); Changqing Du, Troy, MI (US); Kaiping Li, Shelby Township, MI (US); Robert D Miller, Lake Orion, MI (US)

(72) Inventors: Dajun Zhou, Troy, MI (US); Changqing Du, Troy, MI (US); Kaiping Li, Shelby Township, MI (US); Robert D Miller, Lake Orion, MI (US)

(73) Assignee: FCA US LLC, Auburn Hills, MI (US)

( * ) Notice: Subject to any disclaimer, the term of this patent is extended or adjusted under 35 U.S.C. 154(b) by 162 days.

(21) Appl. No.: 16/455,084

(22) Filed: Jun. 27, 2019

(65) Prior Publication Data

US 2020/0406327 A1 Dec. 31, 2020

(51) Int. Cl.
*B21D 22/02* (2006.01)
*B21D 24/04* (2006.01)

(52) U.S. Cl.
CPC ..... *B21D 22/02* (2013.01); *B21D 24/04* (2013.01)

(58) Field of Classification Search
CPC ..... B21D 22/02; B21D 24/04
USPC ..... 228/203
See application file for complete search history.

(56) References Cited

U.S. PATENT DOCUMENTS 531,337 A * 12/1894 Saltzkorn et al. ..... B21D 22/22 72/350
2,968,270 A * 1/1961 McChesney ..... B21D 51/2646 72/354.8
4,195,510 A * 4/1980 Juergens ..... B21D 22/26 72/350
5,104,032 A * 4/1992 Spies ..... B23K 33/008 228/173.6
9,914,164 B1 * 3/2018 Siekirk, III ..... B21D 22/22

OTHER PUBLICATIONS

Ghael, Abbas, "Modeling Springback in Stamped Automotive Structures" (2010). Electronic Theses and Dissertations. 188. https://scholar.uwindsor.ca/etd/188.

* cited by examiner

*Primary Examiner* — Adam J Eiseman
*Assistant Examiner* — P Derek Pressley
(74) *Attorney, Agent, or Firm* — Ralph E. Smith

(57) ABSTRACT

A metal blank is clamped between upper and lower binders with the metal blank engaging against a protrusion extending from a binder surface of any of the upper binder, the lower binder, and both upper and lower binders, to create a binder gap between the metal blank and the binder surface adjacent the protrusion. The binder gap prevents cooperating springback control binder elements of the binder surface from actively engaging the metal blank. The metal blank is drawn into a cavity, with the protrusion riding on the metal blank until the protrusion falls off an edge of the metal blank, which closes the binder gap between the metal blank and the binder surface causing the cooperating springback control binder elements to actively engage the blank for the post-forming stretching operation.

14 Claims, 4 Drawing Sheets

METAL FORMING METHOD INCLUDING POST-FORMING STRETCHING TO CONTROL SPRINGBACK

FIELD

The present disclosure relates to metal forming methods including a post-forming stretching operation to control springback.

BACKGROUND

Sheet metal that is subjected to a metal stamping process often will springback toward its original shape such that angles formed in the stamped part will be larger than those of the corresponding stamping tool. Springback can result in angular changes of the side wall, side wall curl, or twist or torsion springback. It is desirable to reduce such springback to improve dimensional and shape quality and consistency in the stamped parts.

Traditionally, side wall curl spring back is controlled using a post-forming stretching operation. Commonly assigned U.S. Pat. No. 9,914,164, which is hereby incorporated herein by reference in its entirety, discloses a post-forming stretching operation in which stingers or teeth are brought into contact with the sheet metal blank using a double lower binder and cushion system. Unfortunately, most traditional metal stamping machines lack such a double lower binder and cushion system.

SUMMARY

In an aspect of the present disclosure, a metal forming method including a post-forming stretching operation to control springback is provided. The metal forming method includes positioning a metal blank within a metal stamping tool between an upper binder and a lower binder. The metal blank is clamped between the upper and lower binders with the metal blank engaging against a protrusion extending from a binder surface of any of the upper binder, the lower binder, and both the upper and lower binders, to create a binder gap between the metal blank and the binder surface adjacent the protrusion. The binder gap prevents cooperating springback control binder elements of the binder surface from actively engaging the metal blank. The metal blank is drawn into a cavity, with the protrusion riding on the metal blank until the protrusion falls off an edge of the metal blank, which closes the binder gap between the metal blank and the binder surface causing the cooperating springback control binder elements to actively engage the blank for the post-forming stretching operation.

In an aspect of the present disclosure, the protrusion comprises a roller that rolls along a surface of the metal blank during the drawing. Alternatively or additionally, the protrusion comprises a non-rotating protrusion that slides along a surface of the metal blank during the drawing.

In an aspect of the present disclosure, the protrusion comprises a plurality of protrusions extending from the binder surface of any of the upper binder, the lower binder, and both the upper and lower binders.

In an aspect of the present disclosure, the protrusion comprises a plurality of aligned upper and lower protrusion pairs extending from the binder surface of the upper and lower binders, respectively, and sandwiching the metal sheet therebetween during the drawing.

In an aspect of the present disclosure, the cooperating springback control binder elements comprise stinger teeth.

Alternatively or additionally, the cooperating springback control binder elements comprise any of a draw bead, a lock bead, a lock step, and stinger teeth.

In an aspect of the present disclosure, the cooperating springback control binder elements comprise stinger teeth and the stinger teeth extend longitudinally along an edge of the cavity with intermittent longitudinal teeth gaps periodically interrupting the stinger teeth. In an aspect, the stinger teeth create corresponding stinger teeth bite marks in the metal blank with corresponding intermittent longitudinal bite gaps periodically interrupting the stinger teeth bite marks. In an aspect, the forming method further includes joining the metal blank to another component by welding in the corresponding intermittent longitudinal bite gaps.

Additional aspects of the present disclosure include any combination of aspects or features selected from the various aspects or features included in the present disclosure.

DRAWINGS

The present invention will become more fully understood from the detailed description and the accompanying drawings.

DETAILED DESCRIPTION

Figure 1:
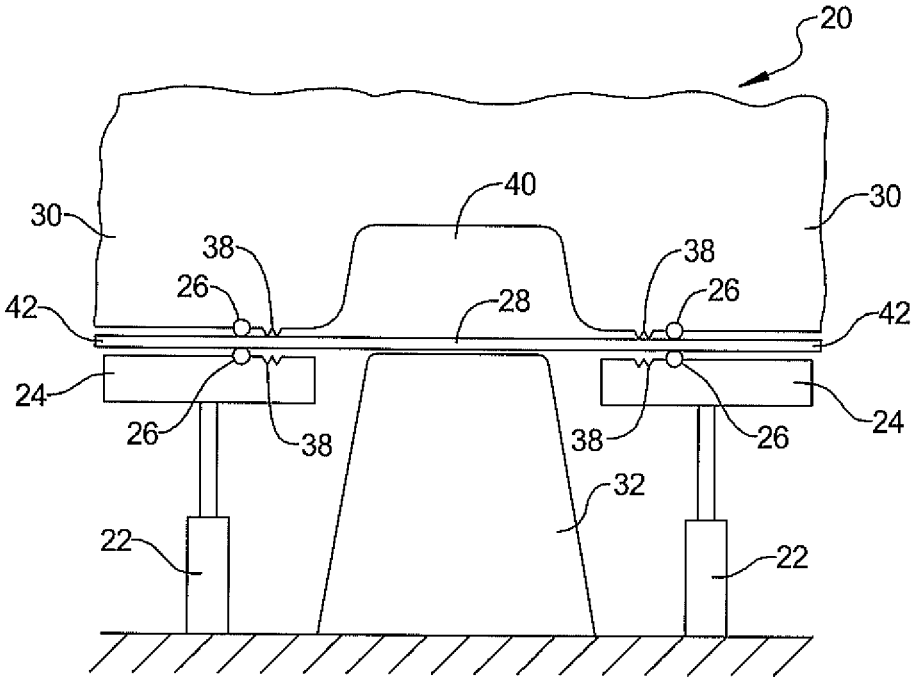
FIG. 1 is a side elevation illustration of one example of the metal stamping tool and metal blank useful in exemplary metal forming methods, including a post-forming stretching operation to control springback in accordance with the present disclosure.

Further areas of applicability will become apparent from the description, claims and drawings, wherein like reference numerals refer to like features throughout the several views of the drawings. It should be understood that the detailed description, including disclosed embodiments and drawings referenced therein are merely exemplary in nature, intended for purposes of illustration only, and are not intended to limit the scope of the present disclosure.

Figure 2:
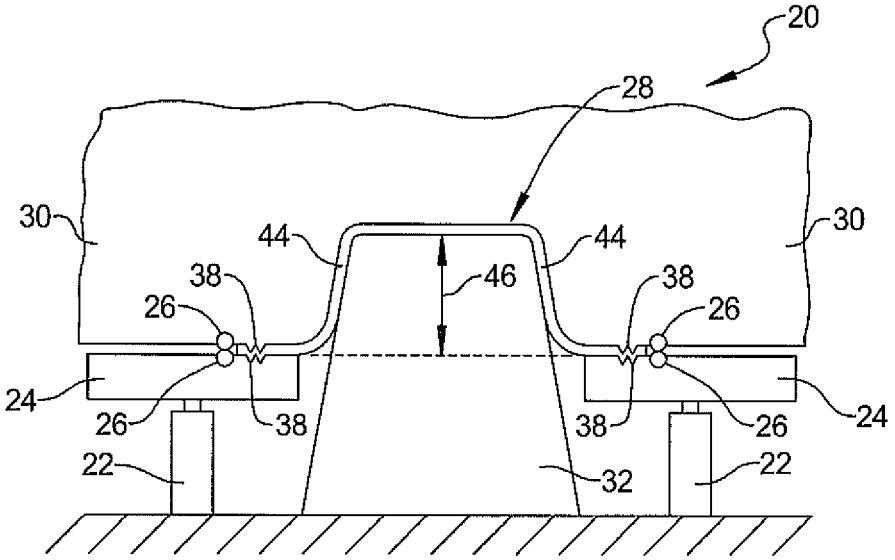
FIG. 2 is a side elevation illustration of the metal stamping tool and metal blank of FIG. 1 in a later stage of the metal forming methods.
Figure 3:
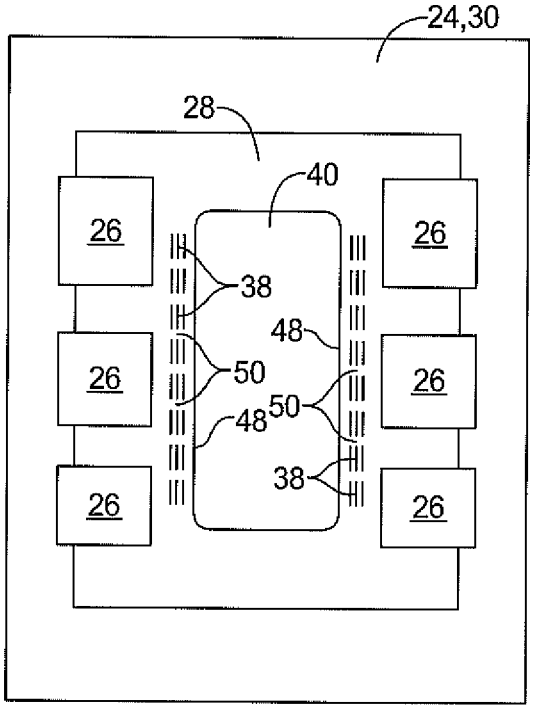
FIG. 3 is a partial top plan illustration of various components of the metal stamping tool and metal blank of FIG. 1.
Figure 4:
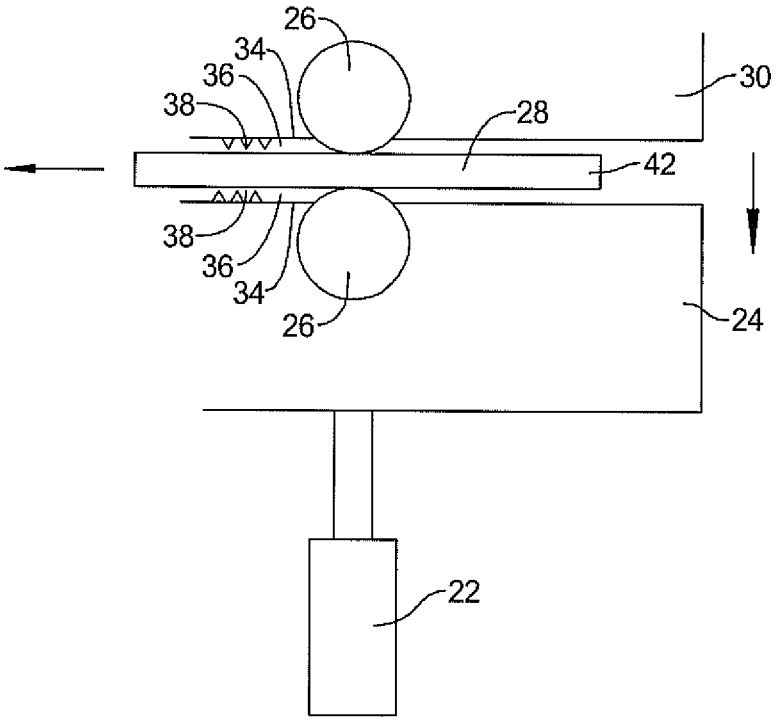
FIG. 4 is a partial side elevation illustration of the metal stamping tool and metal blank of FIG. 1 at a stage of the metal forming methods similar to FIG. 1.
Figure 5:
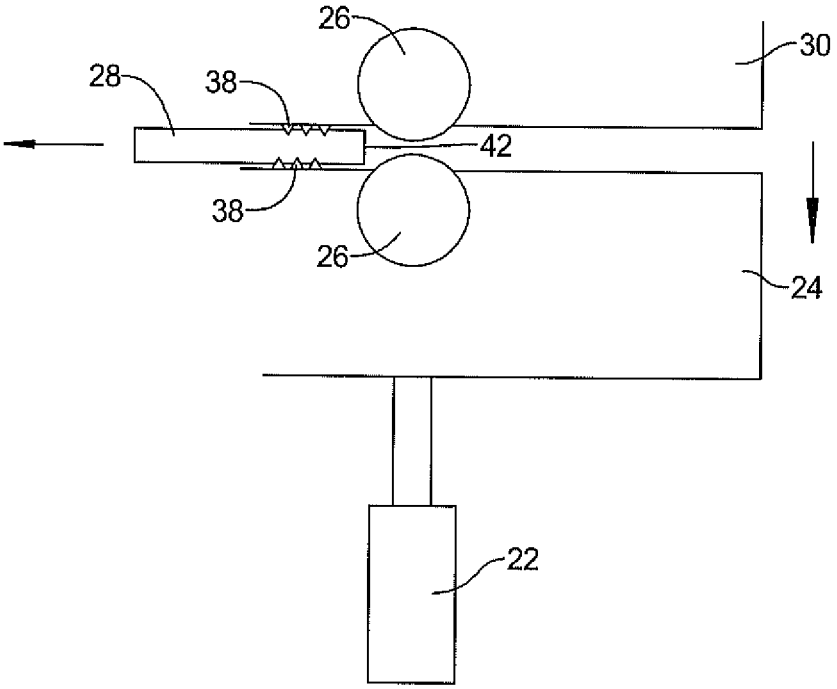
FIG. 5 is a partial side elevation illustration of the metal stamping tool and metal blank of FIG. 1 in a later stage of the metal forming methods similar to FIG. 2.
Figure 6:
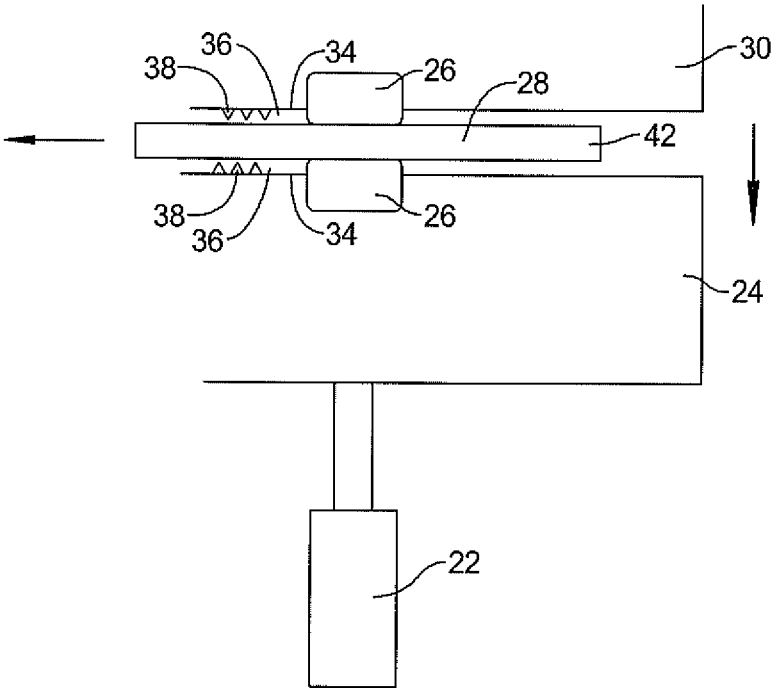
FIG. 6 is a partial side elevation illustration similar to FIG. 4 of a modified metal stamping tool and metal blank.
Figure 7:
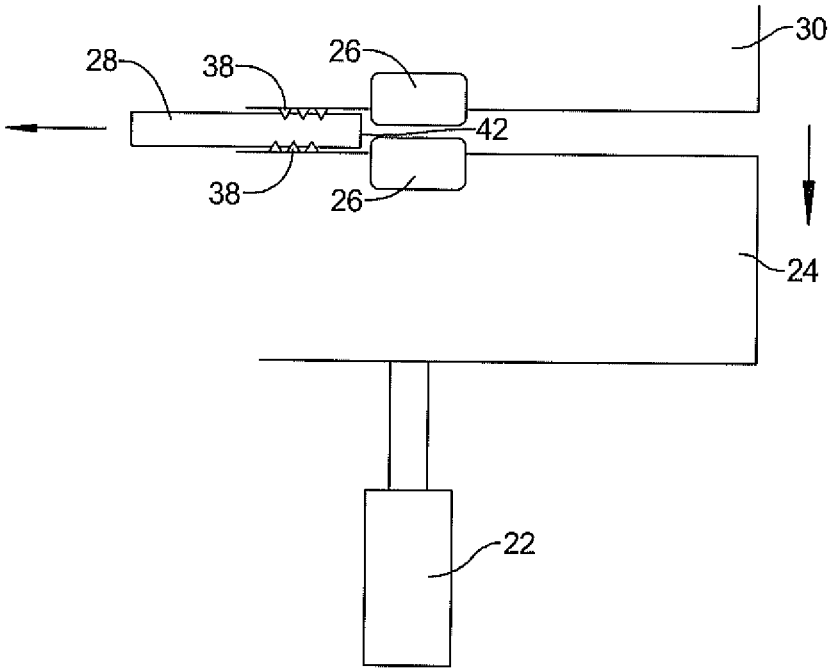
FIG. 7 is a partial side elevation illustration similar to FIG. 5 of a modified metal stamping tool and metal blank.
Figure 8:
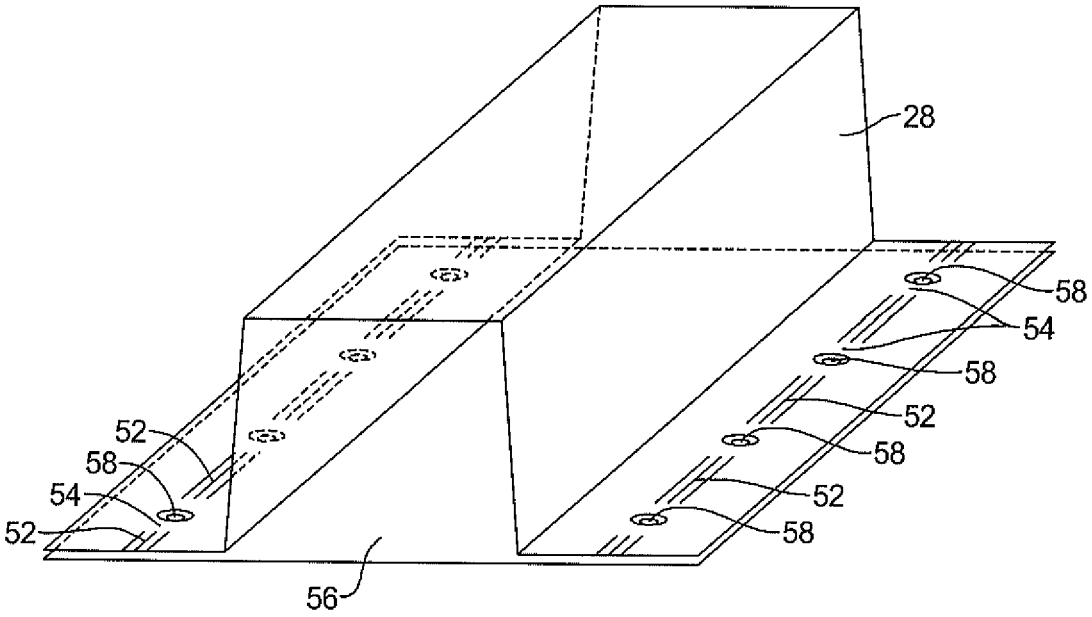
FIG. 8 is a perspective illustration of one example metal blank joined to another component by welding in some exemplary metal forming methods including a post-forming stretching operation to control springback in accordance with the present disclosure.

Referring to FIGS. 1-7, examples of metal forming methods including a post-forming stretching operation to control springback in accordance with the present disclosure are described herein. A metal blank 28 is positioned within a metal stamping tool 20 between an upper binder 30 and lower binder 24.

The upper binder 30 moves toward the lower binder 24 to clamp the metal blank 28 between the upper binder 30 and lower binder 24. During this initial clamping, the metal blank 28 engages against, and is sandwiched between pairs of upper and lower protrusions 26 extending from an adjacent binder surface 34 of the lower binder 24 and the upper binder 30, respectively. As a result, a binder gap 36 is initially created between each side of the metal blank 28 and each adjacent binder surface 34, which prevents cooperating springback control binder elements 38 in the adjacent binder surfaces 34 from actively engaging the metal blank 28.

As the upper binder 30 moves down against the lower binder 24 and its supporting cushion pin springs 22, a ram 32 engages and draws the metal blank 28 into the cavity 40 with the metal blank riding on the protrusions 26. As the drawing operation continues, the protrusions 26 fall off blank edges 42 of the metal blank 28 to close the binder gaps 36 between the opposite sides of the metal blank 28 and the adjacent binder surface 34 causing the cooperating springback control binder elements 38 to actively engage the blank 28 during the post-forming stretching operation.

During the post-forming stretching operation, the downward movement of the upper binder 30 continues, which stretches the side walls 44 that have been formed into the metal blank 28. In an aspect, the travel distance of the ram during the post-forming stretch distance is about 90 percent of the overall travel distance 46 of the ram against the metal blank 28.

As noted above, in an aspect, the metal blank 28 is sandwiched between aligned upper and lower pairs of protrusions 26 to create binder gaps 36 between the both sides of the metal blank 28 and the adjacent binder surface 34 of the lower binder 24 and the upper binder 30, respectively. In an alternative aspect, the metal blank 28 is sandwiched between a protrusion 26 on one side and the binder surface 34 of the upper or lower binder, 30 and 24 respectively, on the other side. Thus, a binder gap 36 is formed on one side of the metal blank 28, but the other side of the metal blank 28 rests against the binder surface 34 of the relevant binder. In this alternative aspect, the cooperating springback control binder elements 38 are recessed below the binder surface 34 of the relevant binder.

In an aspect, a plurality of spaced apart protrusions 26 is provided on opposite lateral sides of the cavity 40. Additionally or alternatively, one long protrusion 26 is provided on opposite lateral sides of the cavity 40. In another aspect, the protrusions 26 comprise rollers 26 that roll along its contacting surface of the metal blank 28 during at least part of the drawing operation. Additionally or alternatively, the protrusions 26 comprise non-rotating protrusions 26 that slide along its contacting surface of the metal blank 28 during at least part of the drawing operation.

In an aspect, the cooperating springback control binder elements 38 comprise stinger teeth 38. Alternatively or additionally, the cooperating springback control binder elements 38 comprise any of a draw bead 38, a lock bead 38, and a lock step 38. In another aspect, the stinger teeth 38 create corresponding stinger teeth bite marks 52 in the metal blank 28. These corresponding stinger teeth bite marks 52 are typically relatively insignificant, shallow deformations of the metal blank 28 compared to the corresponding deformations in the metal blank 28 caused by other cooperating springback control binder elements 38, such as draw beads 38, lock beads 38, and lock steps 38.

In another aspect, the cooperating springback control binder elements 38, for example stinger teeth 38, extend longitudinally along opposite sides or cavity edges 48 of the cavity 40 with intermittent longitudinal teeth gaps 50 periodically interrupting the stinger teeth 38. Here, the term "longitudinally" is simply intended to distinguish the longer lengthwise direction from the transverse or width direction of the cooperating springback control binder elements 38. As a result, corresponding intermittent longitudinal bite gaps 54 periodically interrupt the stinger teeth bite marks 52 in the metal blank 28.

In an aspect, the forming method includes joining the now formed metal blank 28 to another component 56 by welding in the corresponding intermittent longitudinal bite gaps 54, creating spot welds 58. In an aspect, the welding is accomplished using a resistant spot welding process. Alternatively or additionally, the welding is accomplished using a laser welding process. Such a joining process is facilitated by the relatively insignificant, shallow nature of the corresponding intermittent longitudinal bite gaps 54 resulting from the use of stinger teeth 38 as the cooperating springback control binder elements. Thus, the joining process creates the joints 58 in line with the longitudinal bite marks 54, which means the bite marks 54 do not need to be removed and reduces metal blank waste.

The description of the invention is merely exemplary in nature and, thus, variations that do not depart from the gist of the invention are intended to be within the scope of the invention, Such variations are not to be regarded as a departure from the spirit and scope of the invention.

What is claimed is:

1. A metal forming method including a post-forming stretching operation to control springback, the metal forming method comprising:

positioning a metal blank within a metal stamping tool between an upper binder and a lower binder;

clamping the metal blank between the upper and lower binders with the metal blank engaging against a protrusion extending from a binder surface of any of the upper binder, the lower binder, and both the upper and lower binders, to create a binder gap between the metal blank and the binder surface adjacent the protrusion that prevents cooperating springback control binder elements positioned in the binder gap from actively engaging the metal blank; and drawing the metal blank into a cavity with the protrusion riding on the metal blank until the protrusion falls off a blank edge of the metal blank to close the binder gap between the metal blank and the binder surface and to cause the cooperating springback control binder elements to actively engage the blank for the post-forming stretching operation.

2. The metal forming method of claim 1, wherein the protrusion comprises a roller that rolls along a surface of the metal blank during the drawing.

3. The metal forming method of claim 1, wherein the protrusion comprises a non-rotating protrusion that slides along a surface of the metal blank during the drawing.

4. The metal forming method of claim 1, wherein the protrusion comprises a plurality of protrusions extending from the binder surface of any of the upper binder, the lower binder, and both the upper and lower binders.

5. The metal forming method of claim 1, wherein the protrusion comprises a plurality of aligned upper and lower protrusion pairs extending from the binder surface of the upper and lower binders, respectively, and sandwiching the metal sheet therebetween during the drawing.

6. The metal forming method of claim 1, wherein the cooperating springback control binder elements comprise any of a draw bead, a lock bead, a lock step, and stinger teeth.

7. The metal forming method of claim 1, wherein the cooperating springback control binder elements comprise stinger teeth.

8. The metal forming method of claim 7, wherein the stinger teeth extend longitudinally along an edge of the cavity with intermittent longitudinal teeth gaps periodically interrupting the stinger teeth.

9. The metal forming method of claim 8, wherein the stinger teeth create corresponding stinger teeth bite marks in the metal blank with corresponding intermittent longitudinal bite gaps periodically interrupting the stinger teeth bite marks, and wherein the forming method further comprises joining the metal blank to another component by welding in the corresponding intermittent longitudinal bite gaps.

10. The metal forming method of claim 1, wherein the protrusion comprises a plurality of aligned upper and lower protrusion pairs extending from the binder surface of the upper and lower binders, respectively, and sandwiching the metal sheet therebetween during the drawing, and wherein the plurality of aligned upper and lower protrusion pairs comprise rollers that roll along opposite surfaces of the metal blank during the drawing.

11. The metal forming method of claim 10, wherein the cooperating springback control binder elements comprise stinger teeth.

12. The metal forming method of claim 1, wherein the protrusion comprises a plurality of aligned upper and lower protrusion pairs extending from the binder surface of the upper and lower binders, respectively, and sandwiching the metal sheet therebetween during the drawing, and wherein the plurality of aligned upper and lower protrusion pairs comprise non-rotating protrusions that slide along opposite surfaces of the metal blank during the drawing.

13. The metal forming method of claim 12, wherein the cooperating springback control binder elements comprise stinger teeth.

14. The metal forming method of claim 1 wherein the protrusion comprises a curved shape.

* * * * *